US005951313A

United States Patent [19]

Arimoto

[11] Patent Number: 5,951,313

[45] Date of Patent: Sep. 14, 1999

[54] DISCHARGE LAMP LIGHTING DEVICE AND LAMP SOCKET

[75] Inventor: Kazuhiko Arimoto, Kashiwa, Japan

[73] Assignee: ITL Corporation, Tokyo, Japan

[21] Appl. No.: 09/026,868

[22] Filed: Feb. 20, 1998

[30] Foreign Application Priority Data

Nov. 11, 1997 [JP] Japan ..... 9-325211

[51] Int. Cl.[6] ..... H01R 29/00

[52] U.S. Cl. ..... 439/188; 200/51.09

[58] Field of Search ..... 439/188; 200/51.09

[56] References Cited

U.S. PATENT DOCUMENTS 2,345,414 3/1944 Mueller ..... 439/231

4,283,102 8/1981 Richier ..... 439/188

5,069,632 12/1991 Avitan ..... 439/188

5,743,757 4/1998 Chen ..... 200/51.09

*Primary Examiner*—Neil Abrams

*Assistant Examiner*—J. F. Duverne

*Attorney, Agent, or Firm*—Kane, Dalsimer, Sullivan, Kurucz, Levy, Eisele and Richard, LLP

[57] ABSTRACT

The purpose of the invention is to prevent an occurrence of high voltage when a lamp 10 is not yet attached in a more reliable manner. In this invention, there is a provision of switch means 70 for turning on/off an electrical connection between a ballast chock 50 and a power source 60 at a portion of a lamp socket 20. There is also a provision of delay means for preventing a generation of spark between the lamp 10 and a high voltage contact member 216 on the side of the lamp socket 20.

9 Claims, 4 Drawing Sheets

DISCHARGE LAMP LIGHTING DEVICE AND LAMP SOCKET

BACKGROUND OF THE INVENTION

This invention relates to a discharge lamp lighting device including an interlocking mechanism, and more particularly to a technique which can effectively be applied to such a small-sized discharge lamp as a metal halide lamp which can be attached by means of threading engagement to a lamp socket.

In general, a discharge lamp (hereinafter sometimes simply referred to as the "lamp") such as a mercury lamp, a sodium lamp, or a metal halide lamp is high in luminous efficiency. On the other hand, it has such handling disadvantages of the lamp that the work for attaching the lamp is troublesome, and the like. In order to make it easier to handle the lamp, a discharge lamp is developed which can be attached by means of threading engagement to a lamp socket as in an incandescent lamp (see Japanese Patent Unexamined Publication (KOKAI) No. 6301/81).

Another disadvantage, with which the above conventional lamp is encountered, is that there is a need of a provision of a start circuit for starting the lighting of the lamp. The worse is that there is a need of a provision of such a high voltage as, for example, 3.5 to 5 kV. In consideration of the high voltage for starting, a light device for a discharge lamp is usually provided with a safety measure (so-called interlocking mechanism) for preventing an occurrence of high voltage when the lamp is not yet attached to the lamp socket. In the conventional interlocking mechanism, there is a provision of a switch capable of performing a switching operation depending on whether the lamp is attached or not, so that the start circuit will not be actuated when the lamp is not attached, based on the operation of the switch (see Japanese Patent Unexamined Publication (KOKAI) No. 298190/96, or Japanese Utility Model Unexamined Publication (KOKAI) No. 13270/86).

The inventor of the present invention paid attention to the convenience of a discharge lamp which can be attached by means of threading engagement and attempted to develop an interlocking mechanism suitable thereto. As a result of study, it was revealed that there are still several problems to be solved.

The first problem to be solved is that since the power source is not cut off in the method for prohibiting actuation of the start circuit when the lamp is not attached, there is a fear that when the circuit should be subjected to failure by one reason or other, a high voltage would be generated. Therefore, a method capable of more assuredly preventing actuation of the start circuit is demanded.

The second problem is that although the attachment of the lamp by means of threading engagement is performed in the same simple manner as in an incandescent lamp, the method of attachment by one touch is impossible to employ because a screwing-in operation is required. For this reason, there is a possibility that the operator is surprised by sudden lighting of the lamp during the attachment work. Since not only the emission of light but also the abnormal noises due to discharge break-down occur when the lamp is lit, there is also a fear that the operator unconsciously releases his/her hold of the lamp with a result that the lamp is broken.

The third problem is that a spark tends to occur between the lamp and a high contact member on the side of the lamp socket during the attachment work of the lamp by means of threading engagement and as a result, those areas are locally damaged. Although the second and the third problems can be obviated by performing the attachment work of the lamp in the OFF-state of the prime switch of a power source, this cannot be a good solution of the problems because other lamps are also required to be in the OFF-states.

SUMMARY OF THE INVENTION

It is, therefore, the first object of the present invention to provide a more reliable technique for preventing an occurrence of high voltage when a lamp is not yet attached.

It is the second object of the present invention to provide a discharge lamp lighting device suited to be applied to a case where a lamp is attached by means of threading engagement.

It is the third object of the present invention to provide a technique capable of effectively preventing a generation of spark between a lamp and a high voltage contact member on the side of a socket.

According to the present invention, in order to prevent an occurrence of high voltage when a lamp is not yet attached in a more reliable manner, there is a provision of switch means for turning on/off an electrical connection between a ballast chock and a power source at a portion of a lamp socket and the switch means is turned off when the lamp is in the OFF-state. According to this arrangement, the supply of power can be cut off only with respect to a lamp socket to which no lamp is attached yet.

In a specific embodiment of the present invention, the following conditions A through C can be satisfied.

A. the lamp socket is provided at a central portion thereof with an insulated movable sleeve, and the movable sleeve moves axially in accordance with threading engagement between the cap of the discharge lamp and the screwed base of the lamp socket;

B. the movable sleeve is provided at a center thereof with a high voltage contact member to be subjected to a voltage from the ballast choke and the high voltage contact member is brought into electrical connection with the discharge lamp as a result of movement of the movable sleeve by a distance a when the discharge lamp is attached to the lamp socket; and C. the switch means is closed so as to be turned on as a result of movement of the movable sleeve by a distance b (here b>a) when the discharge lamp is attached to the lamp socket.

From a relation of b>a, after the secondary side of the ballast chock is electrically connected to the discharge lamp when a lamp is attached, the switch means for turning on/off the electrical connection between the power source and the ballast chock. Therefore, no spark is generated between the lamp and the high voltage contact member on the side of the lamp socket when the lamp is attached. The spring for pushing the high voltage contact member towards the attached lamp is preferably a coiled spring rather than a normal leaf spring. The leaf spring has a small movable stroke due to resilient deformation. Moreover, only a small force is generated at an early stage of deformation. In this respect, the coiled spring has a large movable stroke and tends to constantly provide a required contact voltage from an early stage of deformation (i.e., early stage of contact between the lamp and the coiled spring). The switch means provided on the lamp socket is preferably a mechanical switch such as a contact switch consisting of a movable contact and a stationary contact.

The ballast chock includes the start circuit for lighting the lamp. The start circuit is preferably designed such that it is actuated with a delay of a predetermined time after the switch means for turning on/off the electrical connection between the power source and the ballast chock. In doing so, the lamp is lit after the completion of the attachment work of the lamp, and therefore, no surprise is given to the worker during the attachment work of the lamp. The prescribed time for delay is determined in consideration of the working time for attaching the lamp. For example, about 3 to 10 seconds are appropriate. If the prescribed time for delay is too short, the lamp is lit during the attachment work of the lamp. In contrast, if the prescribed time for delay is too long such as more than 20 seconds, there is a fear that the operator turns off the prime switch considering that the lamp has an inferior lighting function. The delay means for delaying the actuation of the start circuit can be constituted either by establishing time constants of a resistor and a condenser as component elements of the ballast chock, or by applying a timer circuit to the ballast chock.

Furthermore, since the movable sleeve within the lamp socket surrounds the high voltage contact member on its inner periphery, an occurrence of an electric shock due to wrong operation during the attachment work of the lamp can be prevented. In order to prevent an occurrence of an electric shock in a more reliable manner, the inside diameter of the movable sleeve is set preferably to 5 mm or less so that the entry of a finger is prohibited.

DETAILED DESCRIPTION OF THE EMBODIMENT

Figure 1:
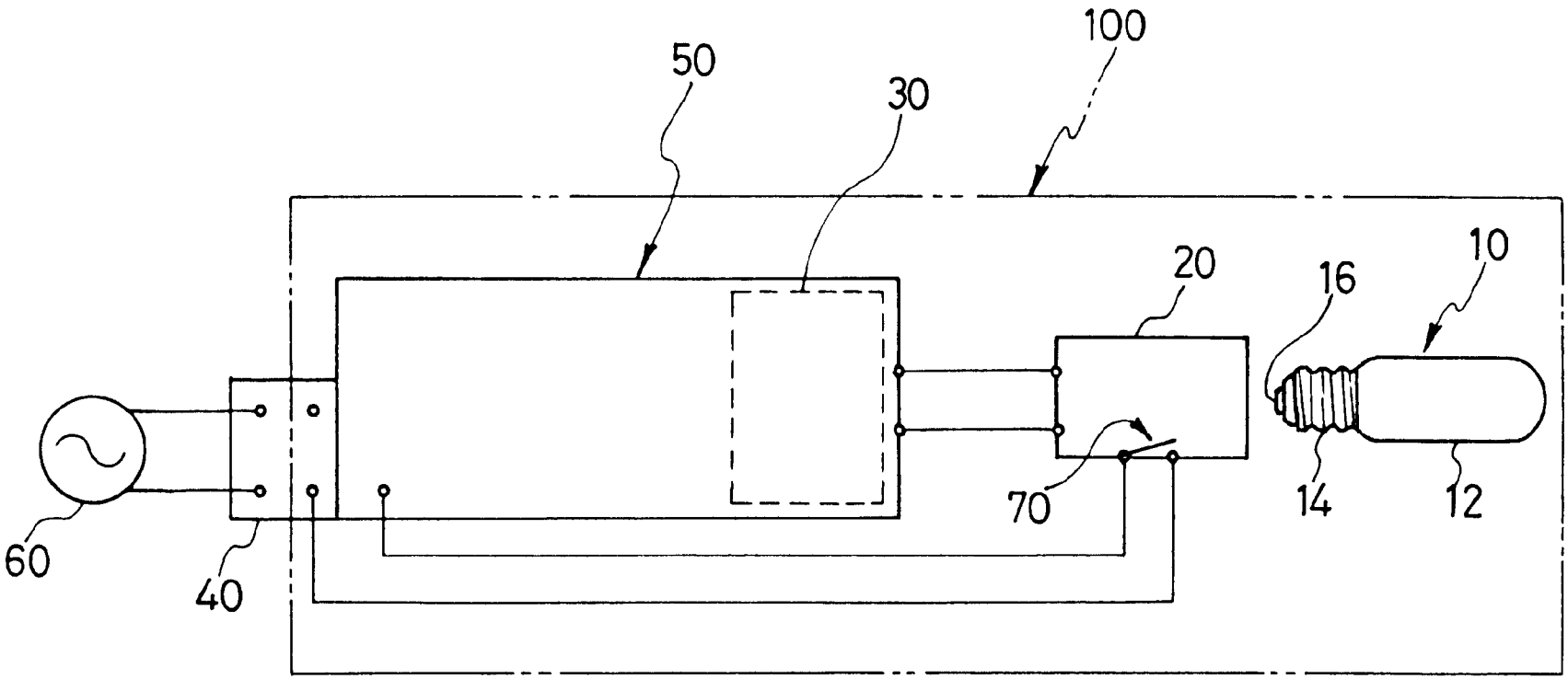
FIG. 1 is an overall construction showing one embodiment of a discharge lamp lighting device according to the present invention.

FIG. 1 is an overall construction showing one embodiment of a discharge lamp lighting device according to the present invention. A lamp 10 to be lit is a metal halide lamp and it includes a screwed cap 14 on a root of a valve 12. The cap 14 portion of the lamp 10 serves as one electrode terminal and a central end portion of the lamp 10 serves as the other electrode terminal 16. The lamp 10 is lit by attaching the cap 14 portion to a lamp socket 20. For this purpose, the lamp socket 20 is connected with a secondary side of a ballast chock 50 including a start circuit 30. The ballast chock 50 is started lighting of the lamp 10 by the start circuit 30, and controlled of electric current by other internal circuit during the time the lamp 10 is lit. A voltage is supplied from a power source 60 to a primary side of this ballast chock 50 through a relay terminal table 40. Here in this embodiment, the lamp 10, the lamp socket 20, and the ballast chock 50 are altogether handled as an illumination equipment unit 100. And a plurality of such illumination equipment units 100 are sequentially wired with use of the relay terminal table 40.

In the present invention, a contact switch 70 acting as switch means for turning on/off an electrical connection between the ballast chock 50 and the power source 60 is located in a part of the lamp socket 20. This contact switch 70 is held in the ON-state when the lamp 10 is attached to the lamp socket 20 but it is brought into the OFF-state when the lamp 10 is not yet attached. Because the contact switch 70 is provided for each lamp socket 20 (namely, for each lamp 20), the supply of power from the power source 60 can be cut off only with respect to the lamp socket 20 to which the lamp is not yet attached, without a need of cutting off the prime switch.

Figure 2:
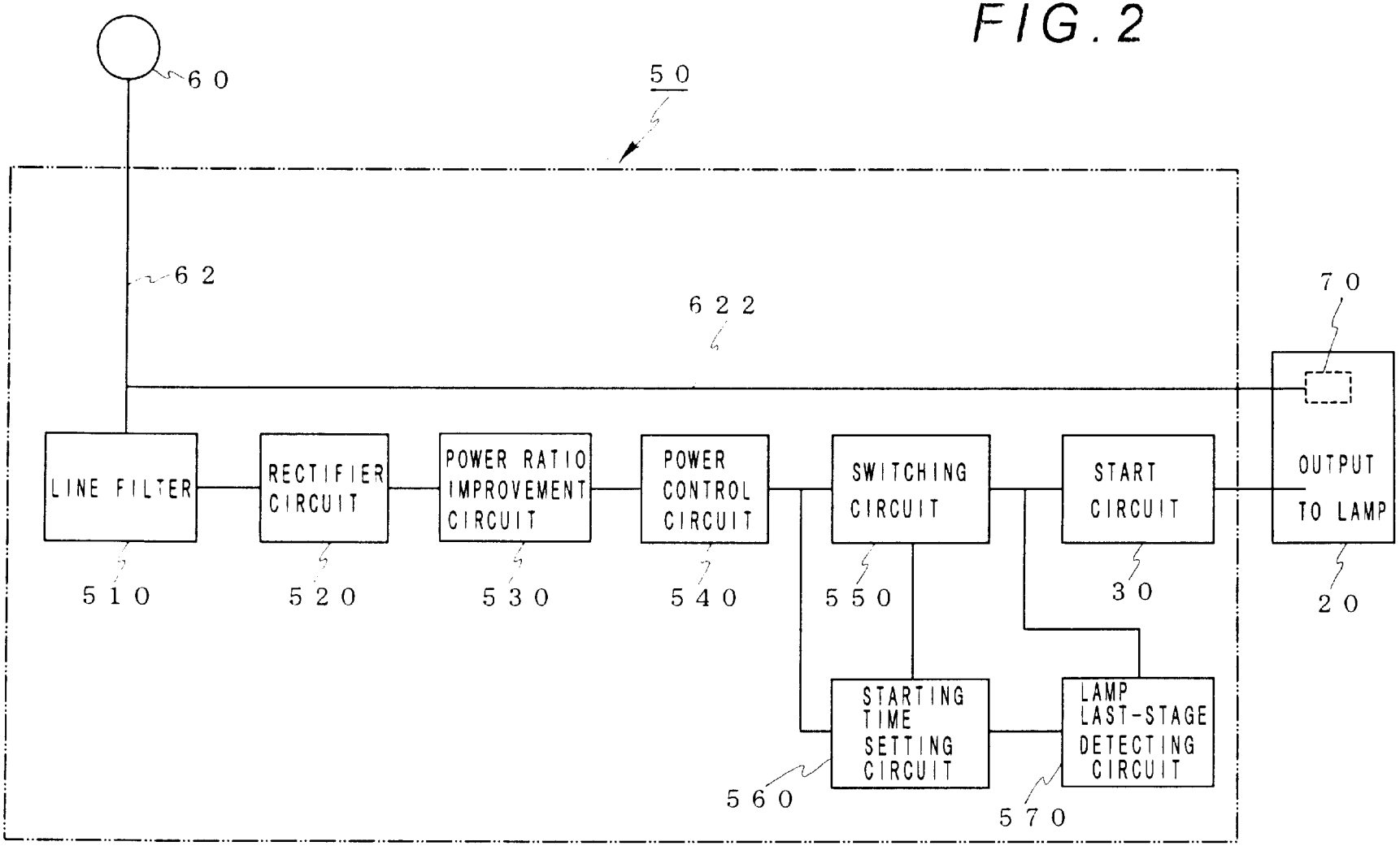
FIG. 2 is a block diagram showing an example of a circuit of the ballast chock of FIG. 1.
Figure 3:
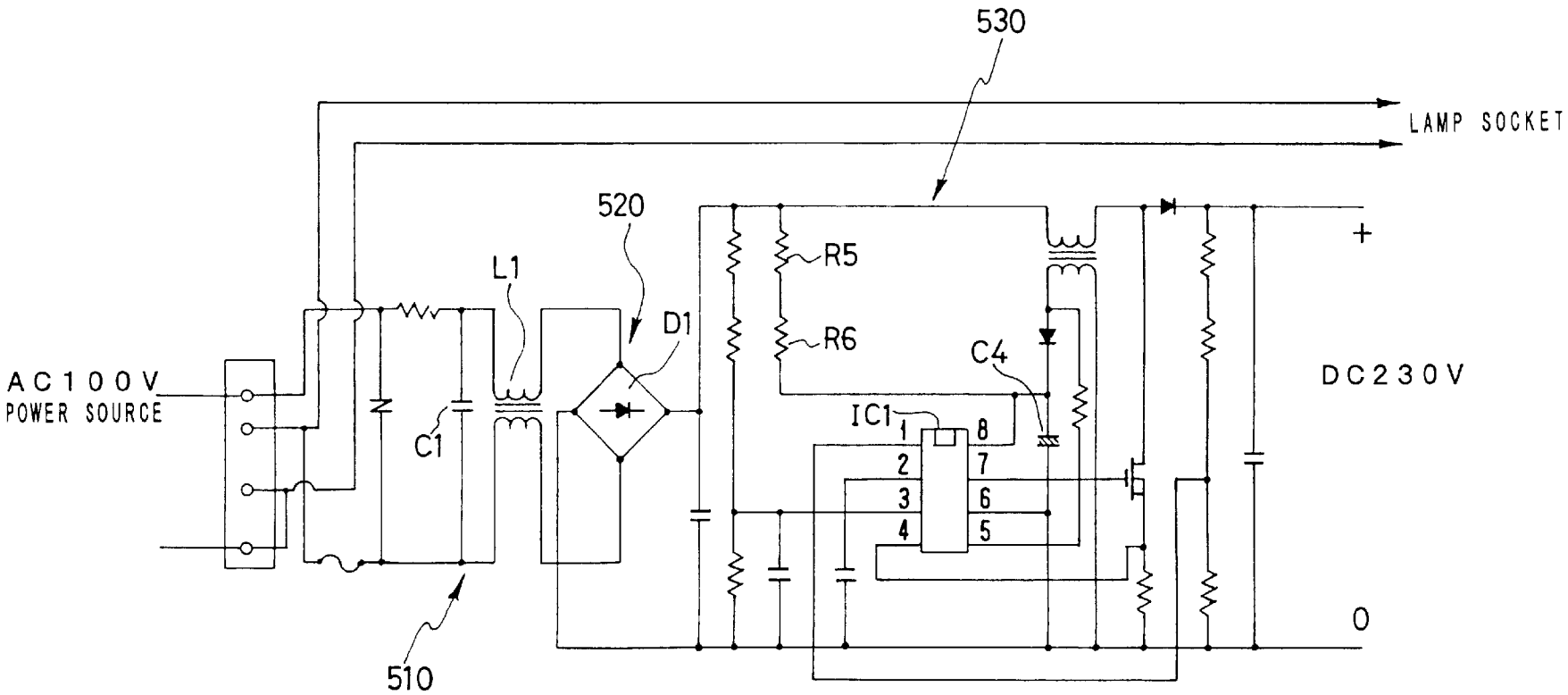
FIG. 3 is a circuit diagram showing a part of the circuit within the ballast chock.

The ballast chock 50 itself containing the start circuit 30 is the same in construction as the conventional circuit only excepting a part of the construction. FIG. 2 is a block diagram showing an overall circuit construction of the ballast chock 50 and FIG. 3 is a circuit diagram showing one example of a circuit from an input portion to a power ratio improvement circuit. An input from the power source 60 is applied to a line filter 510 disposed within the ballast chock 50, through an input line 62. The line filter 510 is a filter circuit for preventing the noises of high frequency generated within the ballast chock 50 from returning towards the input line 62. The line filter 510 includes elements such as a condenser C1, an inductance coil L1, and the like. An alternating voltage applied to the input line 62 is applied to a rectifier circuit 520 through the line filter 510. The rectifier circuit 520 is a circuit including a diode D1 and it is a circuit for converting an alternating current into a direct current.

A source voltage of alternating current of 100 V is rectified by the rectifier circuit 520 and then applied to a power ratio improvement circuit 530. The power ratio improvement circuit 530 improves the power ratio from 0.5 to 0.98 through 0.99, and it further prevents a current of higher harmonic wave from the power source 60. In this power ratio improvement circuit 530, there is provided, in addition to a provision of an IC1 acting as an IC for a switching power source, a condenser C4 which is charged through resistors R5, R6. When the condenser C4 is charged and a power source terminal (8-th pin) for the switching power source is brought to a level slightly higher than 10 V, for example, the circuit is actuated and brought into a lighting state. So, in this ballast chock 50, the start circuit 30 to follow is delayed for about 5 seconds by appropriately setting the respective values of the resistors R5, R6. Since it is an ordinary practice that the start circuit 30 is actuated as soon as the power source is turned on, the values of the resistors R5, R6 are set, for example, to about 7.5 kΩ, and the value of the condenser C4 is set, for example, to about 100 $\mu$F. Contrary to the ordinary practice, here in this embodiment, a delay of 5 seconds is obtained by setting the values of the resistors R5, R6 to about 33 kΩ and the value of the condenser C4 to about 470 $\mu$F. This delay of 5 seconds is effective to eliminate the inconvenience that the lamp 10 is lit during the attachment work of the lamp 10 to the lamp socket 20.

The power ratio improvement circuit 530 generates a direct current of 230 V and applies this voltage to a power control circuit 540. The power control circuit 540 is a circuit for controlling the input power into the lamp 10 within an appropriate range, and it has a function for controlling the power to a constant level of direct current. An output from the power control circuit 540 is applied to a switching circuit 550 and a starting time setting circuit 560. The switching circuit 550 acts as a DC-AC inverter, and converts the power into an alternating current of 250 Hz to meet the lighting of the lamp 10 by alternating current. An output from the switching circuit 550 is applied to the start circuit 30. Then, in the start circuit 30, a starting voltage of 3.5 kV to 5 kV is generated with use of an edge of the alternating current. The starting time setting circuit 560 is a circuit for controlling the actuating time of the start circuit 30, and is a circuit for appropriately controlling the time required for outputting a starting pulse of high voltage to a range from a few seconds to ten times a few second. Since the lamp 10 tends to raise the lamp voltage at the last stage of its service life, abnormality of the lamp voltage can be detected by utilizing this nature of the lamp 10. A lamp last-stage detecting circuit 570 is a circuit for detecting the last stage of the service life of a lamp in order to stop the actuation of the switching circuit 550, thereby preventing an occurrence of breakage of the lamp 10.

Figure 4:
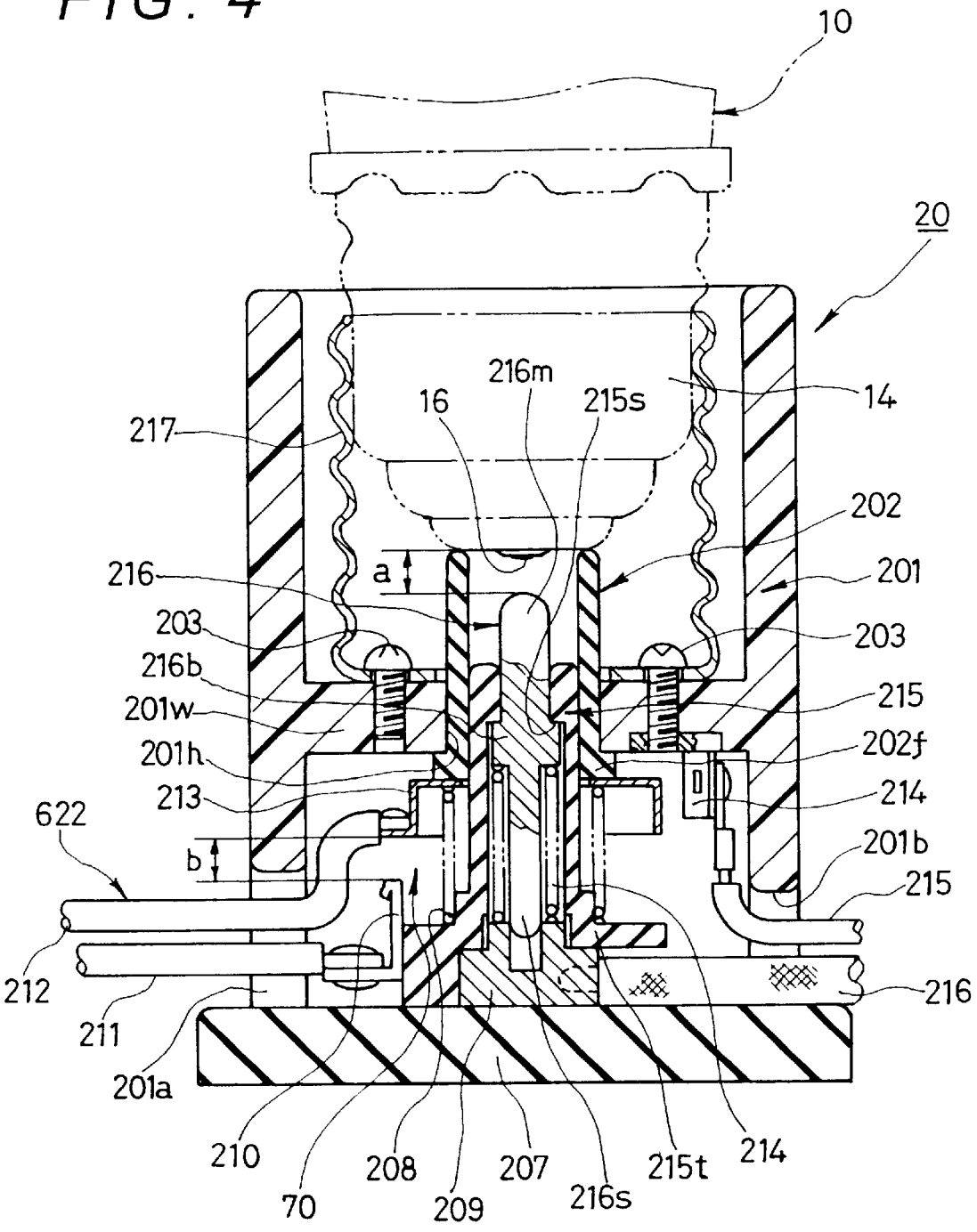
FIG. 4 is a sectional view showing one example of a lamp socket according to the present invention, in which a lamp is not yet attached to the lamp socket.

The lamp socket 20 is connected, as previously mentioned, with the various component parts so that an output from the ballast chock 50 is applied thereto. At the same time, a branch line 622 branched from the input line 62 is connected to the contact switch 70 within the lamp socket 20. FIG. 4 is a view showing a sectional construction of the lamp socket 20 to which the lamp 10 is not yet attached. As shown in this Figure, the lamp socket 20 includes a planar base portion 207. The base portion 207 is a molded member from electrically insulative heat resisting resin such as phenol, silicone, or the like. A socket body 201 is supported by one surface of the base portion 207. The socket body 201 is also made from the same insulative material as the base portion 207. The socket body 201 exhibits a sleeve-like configuration as a whole. The socket body 201 integrally includes a partition wall 201*w* formed on an intermediate portion within the sleeve-like body thereof. The socket body 201 is provided on a bottom portion thereof with lead-in ports 201*a*, 201*b* for leading therein two lead wires 211, 212 which constitute the branch line 622, and two lead wires 215, 215 connecting to the ballast chock 50, respectively. The two lead wires 211, 212 on the side of the branch line 622 and the lead wire 215 in the connecting line are connecting lines for meeting a low voltage. The other lead wire 216 of the connecting line is a connecting line meeting a high voltage. Those respective lines enter an internal space of the lamp socket 20 beneath the partition wall 201*w* and are connected to respective terminals within the lamp socket 20.

On the other hand, the lamp socket 20 above the partition wall 201*w* is provided in a recess thereof with a screwed base 217 which is in conformity with the screw of the cap 14 of the lamp 10. The screwed base 217 is fixed to the partition wall 201*w* by a plurality of machine screws 203. One of the machine screws 203 acts as a part for electrically connecting the screwed base 217 to a low voltage terminal 214.

Looking into the center of the interior of the socket body 201, there is a provision of a sleeve-like member 215 standing on the base portion 207. The sleeve-like member 215 is pierced through a center hole 201*h* of the partition wall 201*w* from one surface of the base portion 207, and an uppermost portion of its head portion is pierced even through the bottom portion of the screwed base 217. The sleeve-like member 215 is a molded member from electrically insulative shaping material (for example, heat resisting shaping material, Tiemold, manufactured by Hitachi Kasei Kabushiki Kaisha) chiefly composed of glass fibers. The sleeve-like member 215 has an inner stepped portion 215*s* formed on an inner periphery near the head portion, and an outer stepped portion 215*t* formed on an outer periphery near the bottom portion. A movable sleeve 202 made from the same insulative material as the sleeve-like member 215 is engaged with the outer periphery of the head portion of the sleeve-like member 215. The movable sleeve 202 is capable of movement in an axial direction within the socket body 201 while being guided by the inner periphery of the center hole 201*h* of the partition wall 201*w* and the outer periphery of the sleeve-like member 215. The movable sleeve 202 is subjected to a force of an outer coiled spring 208 with the outer stepped portion 215*t* of the sleeve-like member 215 serving as a spring retainer and also subjected to a force directing towards the opening side of the screwed base 217. However, since the movable sleeve 202 includes an outwardly facing flange 202*f* on an end portion near the base portion 207, the flange 202*f* contacts the partition wall 201*w* and retained in a prescribed position. The other spring retainer of the outer coiled spring 208 is a movable contact 213 of the contact switch 70, and the movable sleeve 202 is subjected to a force of the coiled spring 208 through the movable contact 213. The movable contact 213 is a contact to be connected to the lead wire 212. The movable contact 213 constitutes the contact switch 70 together with a stationary contact 210 which is away by a distance b from the movable contact 213. The stationary contact 210 performs a switching operation in order to bring the contact switch 70 from the OFF-state to the ON-state when the movable contact 213 moves a distance b together with the movable sleeve 202.

On the other hand, turning now a look to the inner periphery of the sleeve-like member 215, there is a provision of a rod-like high voltage contact member 216 made of conductive metal. The high voltage contact member 216 is a member electrically connected to an electrode terminal 16 at the center of the cap 14 of the lamp 10 when the lamp 10 is attached. The high voltage contact member 216 is middle in diameter at its head portion 216*m* near the opening of the screwed base 217, reduced in diameter at it tail portion 216*s* near the base portion 207, and enlarged in diameter at it intermediate portion 216*b* between the head portion 216*m* and the tail portion 216*s*. The high voltage contact member 216 is urged in a direction away from the base portion 207 by the inner coiled spring 214. However, since the inner stepped portion 215*s* of the sleeve-like member 215 acts as a stopper against the enlarged diameter portion 216*b* of the high voltage contact member 216, the high voltage contact member 216 keeps a position of a prescribed height. This position of a prescribed height is away by a distance a from the end portion of the opening of the movable sleeve 202 towards the interior of the movable sleeve 202. Here, a relation between the distance a and the distance b should satisfy b>a. In doing so, when the lamp 10 is attached to the lamp socket 20, the contact switch 70 between the power source 60 and the ballast chock 50 can be turned on after the secondary side of the ballast chock 50 is electrically connected to the lamp 10. The largeness of the distances b and a is about 2 to 5 mm, for example. It is preferable that the inside diameter of the movable sleeve 202 is set, for example, to about 5 mm or less to prevent the finger from not touching the high voltage contact member 216 inside the movable sleeve 202 when the lamp 10 is not attached, so that an occurrence of electric shock due to abnormal circuit can be prevented.

In the illustrated example, there is a provision of a high voltage terminal 209 for electrically connecting the high voltage contact member 216 and the lead wire 206, the high voltage terminal 209 is served as a spring retainer beneath the inner coiled spring 214, and a screwing-in amount of the lamp 10 is limited with use of a blind hole formed in the center of the high voltage terminal 209. It is accepted, however, that by increasing the mechanical strength of the stationary contact 210, for example, the stationary contact 210 can be served as a stopper for limiting the screwing-in amount of the lamp 10. In that case, it is also accepted that the high voltage terminal 209 is eliminated and the high voltage contact member 216 and the lead wire 206 are directly connected together.

As a method for starting the starting circuit 30 with a delay of a prescribed time after the contact switch 70 is turned on as a result of contact of the electrode terminal 16 of the lamp 10 with the high voltage contact member 216 caused by the movable sleeve 202 pushed downwardly with the progress of the attachment work of the lamp 10, means for applying a timer circuit may be provided on an intermediate part of the branched line 622 branched from the input line 62.

What is claimed is:

1. A discharge lamp lighting device comprising:

a lamp socket including a screwed base for threadingly engaging a cap of a discharge lamp;

a ballast chock a primary side of which is connected to a power source and a secondary side of which supplies a voltage to said lamp socket; and switch means situated at a portion of said lamp socket and for performing an ON/OFF operation depending on whether said discharge lamp is attached to said lamp socket;

said discharge lamp lighting device further satisfying the following conditions A through C;

A. said lamp socket is provided at a central portion thereof with an insulated movable sleeve, and said movable sleeve moves axially in accordance with threading engagement between said cap of said discharge lamp and said screwed base of said lamp socket;

B. said movable sleeve is provided at a center thereof with a high voltage contact member to be subjected to a voltage from said ballast choke and said high voltage contact member is brought into electrical connection with said discharge lamp as a result of movement of said movable sleeve by a distance a when said discharge lamp is attached to said lamp socket; and C. said switch means is closed so as to be turned on as a result of movement of said movable sleeve by a distance b (here b>a) when said discharge lamp is attached to said lamp socket.

2. A discharge lamp lighting device according to claim 1, wherein said switch means is turned on after said secondary side of said ballast choke is brought into electrical connection with said discharge lamp when said discharge lamp is attached to said lamp socket.

3. A discharge lamp lighting device according to claim 1, wherein said switch means is a contact switch comprising a movable contact capable of movement in response to an axial movement of said lamp when said lamp is attached, and a stationary contact for performing a switching operation by being contacted or non-contacted with said movable contact.

4. A discharge lamp lighting device according to claim 1, wherein a thrust force for pushing said high voltage contact member towards said discharge lamp is provided by a coil spring.

5. A discharge lamp lighting device comprising:

a lamp socket including a screwed base for threadingly engaging a cap of a discharge lamp;

a ballast chock including a start circuit for starting lighting of said discharge lamp, a primary side of said ballast chock being connected to a power source and a secondary side of said ballast chock supplying a voltage to said lamp socket; and switch means situated at a portion of said lamp socket in order to perform an ON/OFF operation with respect to an electrical connection between said ballast chock and said power source and further performing a switching operation from an ON-state to an OFF-state in association with a linear movement of said discharge lamp caused by screwing-in operation when said cap of said discharge lamp is threadingly engaged with said screwed base, said discharge lamp lighting device further comprising delay means for delaying the actuation of said start circuit within said ballast chock for a prescribed time from the time said switch means is turned on.

6. A discharge lamp lighting device according to claim 5, wherein said delay means is constituted either by establishing time constants of a resistor and a condenser as component elements of said ballast chock, or by applying a timer circuit to said ballast chock.

7. A lamp socket comprising:

a base portion made of an insulative material;

a socket body supported by said base portion and for supporting a screwed base in conformity with a screw of said cap of said discharge lamp;

a sleeve-like member located in a center of the interior of said socket body, said sleeve-like member being made of an insulative member and standing on said base portion;

a movable sleeve made of an insulative material and movably fitted to an outer periphery of said sleeve-like member, said movable sleeve being capable of movement in an axial direction of said socket body in accordance with movement of a discharge lamp threadingly engaged with said screwed base;

retainer means for retaining said movable sleeve in a prescribed position when said discharge lamp is attached a high voltage contact member located in a center of the interior of said movable sleeve away inwardly by a distance a from an opening of said movable sleeve and subjected to force of a spring towards said discharge lamp; and switch means which is in an OFF-state when said discharge lamp is not yet attached, said switch means being capable of turning on an electrical connection between a ballast chock and a power source in order to light up said discharge lamp in accordance with movement of said movable sleeve exceeding a distance b (here b>a) when said discharge lamp is attached.

8. A lamp socket according to claim 7, wherein said movable sleeve has an inside diameter small enough to prohibit entry of a finger.

9. A lamp socket according to claim 7, wherein said spring for exerting a force to said high voltage contact member is a coiled spring.

* * * * *